US010227740B2

(12) United States Patent
Verhaelen et al.

(10) Patent No.: US 10,227,740 B2
(45) Date of Patent: Mar. 12, 2019

(54) MILLING MACHINE FOR WORKING GROUND SURFACES, TRANSFER DEVICE, AS WELL AS METHOD FOR THE TRANSFER OF MILLED-OFF MATERIAL

(71) Applicant: Wirtgen GmbH, Windhagen (DE)

(72) Inventors: Philip Verhaelen, Cologne (DE); Cyrus Barimani, Konigswinter (DE); Juri Wagner, Titz (DE); Stefan Jentsch, Aachen (DE); Bastian Schings, Aachen (DE); Kevin Helmut Schmitz, Düsseldorf (DE); Felix Johannes van der Beek, Heidelberg (DE)

(73) Assignee: Wirtgen GmbH (DE)

( * ) Notice: Subject to any disclaimer, the term of this patent is extended or adjusted under 35 U.S.C. 154(b) by 40 days.

(21) Appl. No.: 15/201,839

(22) Filed: Jul. 5, 2016

(65) Prior Publication Data

US 2017/0009409 A1 Jan. 12, 2017

(30) Foreign Application Priority Data

Jul. 9, 2015 (DE) ..... 10 2015 212 902

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/088; E01C 23/09; E01C 23/12
(Continued)

(56) References Cited

U.S. PATENT DOCUMENTS 2,360,069 A * 10/1944 Stanley ..... B60P 1/36 198/535
3,187,910 A * 6/1965 Decker ..... B60P 1/36 406/39

(Continued)

FOREIGN PATENT DOCUMENTS

DE 102012019016 A1 4/2014
EP 1936034 A2 6/2008

(Continued)

OTHER PUBLICATIONS

European Search Report in corresponding European Patent Application No. EP 16 17 7789, dated Nov. 7, 2016, 8 pp. (not prior art).

*Primary Examiner* — Sunil Singh
(74) *Attorney, Agent, or Firm* — Lucian Wayne Beavers; Patterson Intellectual Property Law, PC

(57) ABSTRACT

In a milling machine for working ground surfaces, comprising a milling device mounted at a machine frame transverse to the direction of travel, comprising at least one first conveying device arranged at the machine frame which accepts the milled-off material from the milling device, at least one second conveying device pivotable, relative to the machine frame and/or the first conveying device, about a horizontal pivoting axis in a predetermined inclination angle range, and laterally about a pivoting axis extending in vertical direction, wherein the first conveying device transfers the milled-off material to the second conveying device, a transfer element with a first transfer opening essentially coaxial to the vertical pivoting axis and open towards the bottom is arranged at the first conveying device, a reception element with a reception opening open towards the top is arranged at the second conveying device, it is provided a lid element covering at least the major part of the reception opening arranged at the reception element, said lid element
(Continued)

comprising a passage opening which connects the transfer opening with the reception opening.

31 Claims, 4 Drawing Sheets

(58) Field of Classification Search
USPC ..... 299/36.1, 39.1, 39.2, 39.4–39.6; 404/90–94, 75, 76
See application file for complete search history.

(56) References Cited

U.S. PATENT DOCUMENTS 3,744,615 A * 7/1973 Plaquet ..... B65G 37/00 198/309
3,772,807 A * 11/1973 Van Valkenburgh ..... E02F 3/08 37/300
4,419,037 A * 12/1983 Niewold ..... B65G 41/002 222/163
5,409,344 A * 4/1995 Tharaldson ..... B60P 1/42 198/314
5,615,990 A * 4/1997 Grieshop ..... B60P 1/42 198/550.1
8,246,270 B2 8/2012 Berning et al.
8,807,867 B2 8/2014 Berning et al.
9,273,433 B2 * 3/2016 Musil ..... E01C 23/088
2007/0122236 A1 5/2007 Gaertner et al.
2011/0272511 A1 11/2011 Hall et al.
2014/0084665 A1 * 3/2014 Motz ..... B65G 37/00 299/39.2
2015/0137577 A1 5/2015 Berning et al.

FOREIGN PATENT DOCUMENTS

EP 2236745 A2 10/2010
EP 2350390 B1 9/2012

* cited by examiner

MILLING MACHINE FOR WORKING GROUND SURFACES, TRANSFER DEVICE, AS WELL AS METHOD FOR THE TRANSFER OF MILLED-OFF MATERIAL

BACKGROUND OF THE INVENTION

1. Field of the Invention

The invention relates to a milling machine, a transfer device, as well as a method for the transfer of milled-off material.

2. Description of the Prior Art

Such milling machines are known as self-propelled milling machines from, for example, EP 1 936 034 A (U.S. Pat. No. 8,246,270), or as surface miners from, for example, EP 2 236 745 A.

In such milling machines, it is provided for a first conveying device arranged in the machine frame to accept the milled-off material from the milling device, in particular a milling drum, and to transfer it to a second conveying device pivotable, relative to the machine frame, about an inclination axis and laterally about a pivoting axis extending transverse to the inclination axis. The milled-off material is discharged at a point of transfer at the upper end of the first conveying device and is accepted, for example, by a reception hopper at the lower end of the second conveying device. In the intermediate area between the upper end of the first conveying device and the lower end of the second conveying device, shielding mats made of, for example, rubber may be provided which ensure that the milled-off material does not exit to the sides at the point of transfer.

Arrangements are generally known in which a reception device at the lower end of the second conveying device is provided in which the milled-off material is passed into a hopper by means of a transfer device, in which case flexible sealings may be provided between the transfer device and the reception device (EP 2 350 390 A).

A problem in this arrangement is reliable sealing of the point of transfer which is due to the relative movement between the two conveying devices that, apart from leakages, leads to quick wear and tear of the sealing devices.

It has already been proposed (DE 10 2012 019 016 A) (US 2014084665) to provide a material transfer device in which sealing elements in the form of two spherical hoods are provided for a sealing towards the top, said spherical hoods being able to slide on top of one another.

Such an arrangement can also be subject to high wear and tear if dust and milled material collect between the spherical hoods and lead to their blockage.

SUMMARY OF THE INVENTION

It is therefore the object of the invention to create a milling machine, and a transfer device and a method for the transfer of milled-off material, respectively, which enable a high degree of operational safety, prevent milled-off material and dust from exiting, and result in low wear and tear of the components interacting with one another.

The aforementioned object is achieved by the features of the claims.

The invention advantageously provides that, in a milling machine for working ground surfaces comprising

- a milling device mounted at a machine frame transverse to the direction of travel,
- at least one first conveying device arranged at the machine frame which accepts the milled-off material from the milling device,

- at least one second conveying device pivotable, relative to the machine frame and/or the first conveying device, about a horizontal pivoting axis in a predetermined inclination angle range, and laterally about a pivoting axis extending in vertical direction, where
- the first conveying device transfers the milled-off material onto the second conveying device,
- a transfer element with a first transfer opening essentially coaxial to the vertical pivoting axis and open towards the bottom is arranged at the first conveying device,
- a reception element with a reception opening open towards the top is arranged at the second conveying device, and
- a lid element covering at least the major part of the reception opening is arranged at the reception element, said lid element comprising a passage opening which connects the transfer opening with the reception opening.

In this arrangement, the transfer element forms an element for reception of the material from the first conveyor, the transfer opening forms an opening at which the material leaves the transfer element, the reception opening forms an opening at which the material is received at the reception element, the reception element forms an element for reception of the material at the second conveyor, and the lid element forms a cover arranged at the reception opening.

As a result of the lid element connecting the reception opening with the transfer opening by means of the passage opening, it is ensured that the milled-off material including dust does not exit to the outside by forming an enclosed or a mostly enclosed channel. At the same time, said material is prevented from being able to get between the lid element and the transfer element or the reception element, respectively. Wear and tear of the elements of the transfer device is thus reduced to a minimum so that the operational safety is increased, and wear and tear is minimized. In this arrangement, the transfer element does preferably not have a degree of freedom of movement in relation to both pivoting axes, the lid element has a degree of freedom about the vertical pivoting axis, and the reception element has a degree of freedom about the horizontal and the vertical pivoting axis. The transfer opening and the passage opening are stationary relative to the machine frame or to the first transport device, respectively, whereas the reception opening may change its position via a change in the inclination angle of the second conveying device.

In each inclination position of the second conveying device, the part of the reception opening not matching the passage opening is at least partially covered by the lid element.

At the same time, reliable sealing between the elements is achievable without being an impediment to pivoting or inclining the second conveying device.

In principle, the lid element may also be partially or entirely manufactured from flexible material.

It is preferably provided for the lid element, on the side facing the reception element, to be curved, essentially about the horizontal pivoting axis, in the shape of a circular arc, and to extend parallel to a surface or supporting structure of the reception element arranged in the surrounding area of the reception opening and adapted to said curvature, or to rest against the same.

As a result, the surrounding area of the reception opening of the reception element is provided with a surface or supporting structure curved about the horizontal pivoting axis in the shape of a circular arc, with the lid element being able to rest on or to slide on said surface or supporting structure at a predetermined distance to the same. It is understood in this arrangement that the lid element, in the surrounding area of the passage opening, also comprises at least one curved surface, with the curvature of each of the interacting surfaces or supporting structures being adapted to one another. It is furthermore understood that the at least one curved surface of the lid element may extend parallel to the curved surface of the reception element on the outside and/or on the inside or may rest against the same.

In a preferred further development, it is provided for the lid element to be pivotable, relative to the transfer element, about the vertical pivoting axis together with the reception element. On the other hand, the reception element may be pivotable, relative to the lid element, about the horizontal pivoting axis.

It is understood that sealing devices may be provided between the lid element and the transfer element or between the reception element and the lid element, respectively.

It is preferably provided for the lid element to comprise a connection element coaxial to the transfer opening and/or to the reception opening and protruding upwards and/or downwards.

Such connection element may be, for example, a pipe socket. A pipe socket protruding upwards may enclose a pipe socket of the transfer element adapted to said pipe socket and enclosing the transfer opening, in which arrangement, should the need arise, a pipe socket of the lid element protruding downwards may additionally engage with the reception opening of the reception element.

The reception element may be pivotable, relative to the transfer element, about the horizontal and the vertical pivoting axis. In this arrangement, it is particularly preferred for the horizontal and the vertical pivoting axis to intersect.

It is preferably provided for a supporting structure pivotable about the vertical pivoting axis to be attached to the first conveying device or to the machine frame, said supporting structure supporting the second conveying device and comprising at least one bearing for the horizontal pivoting axis.

In this arrangement, the supporting structure may preferably accommodate the lower end of the second conveying device in the way of a portal, and may comprise a bearing for the horizontal pivoting axis so that the second conveying device is inclinable, relative to the supporting structure, about the horizontal pivoting axis.

It is preferably provided for the lid element to be attached to the supporting structure. The lid element is thus stationary relative to the supporting structure so that the second conveying device, together with the reception element, is pivotable, relative to the lid element, about the horizontal pivoting axis.

Furthermore, it is preferably provided for the transfer element to be attached to the discharge end of the first conveying device in a stationary fashion or to the machine frame in a stationary fashion, and for the reception element to be attached to the second conveying device in a stationary fashion.

In a preferred embodiment, it is provided for the reception element to be in the form of a pipe section closed at the ends, extending concentrically to the horizontal pivoting axis and having a cross-section in the way of a circular arc. In the way of a circular arc is also understood to mean a structure of polygonal cross-section.

The reception element particularly preferably comprises a closed rear wall which is inclined backwards relative to the vertical pivoting axis. The rear wall causes the milled-off material to be conducted onto the transport belt of the second conveying device without leaving behind any residue material.

The reception element may be connected, in conveying direction of the milled material, to a cover hood of the second conveying device so that the reception element forms a closed channel with the cover hood.

In a further embodiment, it may be provided for the reception element to be pivotable, relative to a stationary lid element, about the horizontal pivoting axis and the vertical pivoting axis, in which arrangement the horizontal pivoting axis preferably intersects the vertical pivoting axis. Intersecting pivoting axes enable a spherical design of the lid element and of the reception element. With sufficient tolerance between the elements, the axes extending orthogonal to one another may also exhibit an offset.

In such an embodiment, it may be provided for the lid element, on the side facing the reception element, to be curved about the point of intersection between the pivoting axes in the shape of a sphere, and to rest against a surface of the reception element arranged in the surrounding area of the reception opening and adapted to said curvature, with the reception element being essentially in the form of a spherical segment.

The lid element may, at least in the area of contact with the reception element and/or the second conveying device, comprise a flexible sealing element. For example, the flexible sealing element may bridge the transition zone from the lid element to the cover hood of a closed second conveying device in such a fashion that a sealing between the reception element and the cover hood is achieved in every pivoting position of the second conveying device.

In one embodiment, it may be provided for the transfer element and the lid element to be connected to one another in integral design. The surfaces of the lid element and of the reception element adapted to one another and/or resting against one another may preferably be curved spherically. In this case, the transfer opening is at once the passage opening. The vertical and the horizontal pivoting axis preferably intersect in this arrangement.

In this embodiment, only two elements movable relative to one another are provided for the transfer device.

In all embodiments, the reception opening extends in a preferably oblong fashion and parallel to the longitudinal direction of the second conveying device. The reception opening exhibits a width that is essentially adapted to the dimensions of the passage opening of the lid element, or of a potential connection element of the lid element or of the transfer element. The arc length of the reception opening curved, in the longitudinal section, in the shape of a circle or sphere is adapted to the predetermined inclination angle range.

The invention furthermore relates to a transfer device for a milling machine which can be retrofitted between a first and second conveying device.

According to the method according to the invention, it is provided for the transfer opening to be connected with the reception opening by means of a passage opening of a lid element which covers at least the major part of the reception opening in each pivoting position of the second conveying device.

Negative pressure is preferably applied to the transfer device.

A suction device and/or spraying device may be connectable to the transfer element and/or to the reception element.

BRIEF DESCRIPTION OF THE DRAWINGS

Hereinafter, embodiments of the invention are illustrated in more detail with reference to the drawings.

The following is shown.

DETAILED DESCRIPTION

Figure 1:
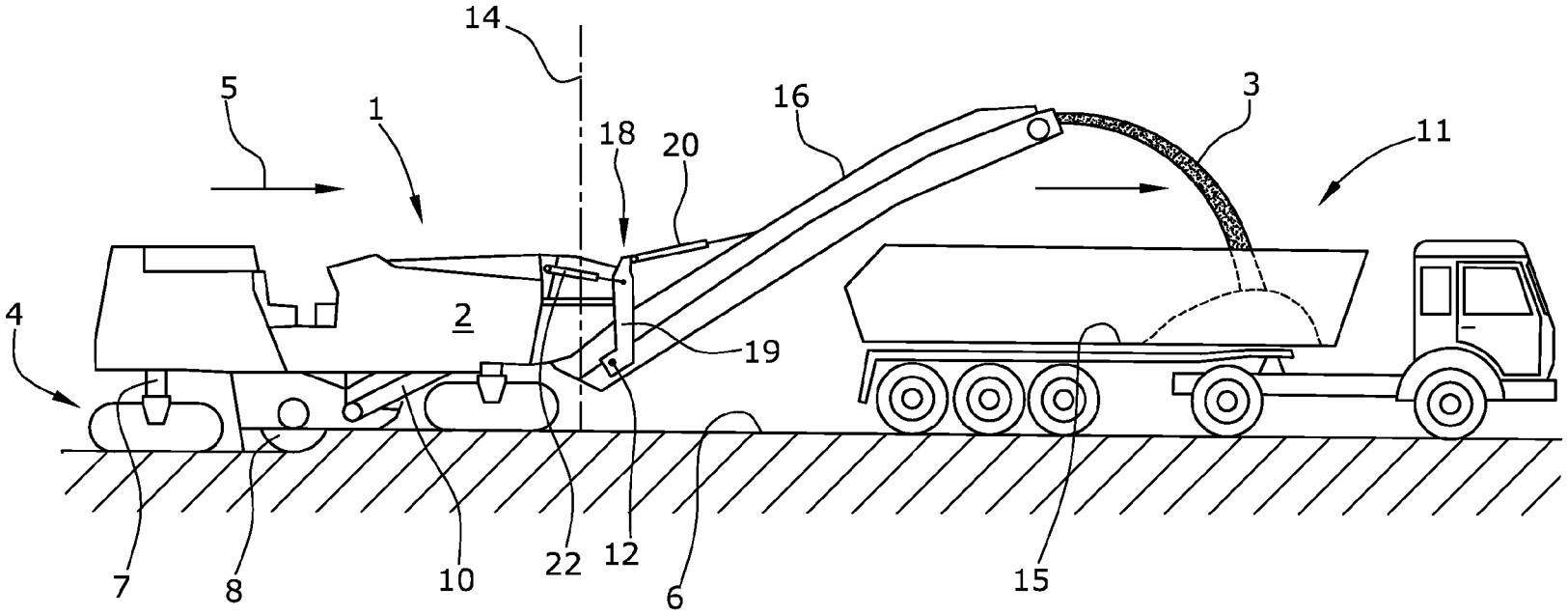
FIG. 1 a road milling machine as an example of a milling machine.

FIG. 1 shows a milling machine 1 using as an example a forward-loading road milling machine. The road milling machine comprises a machine frame 2 which is supported by a chassis 4 comprised of, for example, tracked ground-engaging units or wheels, said chassis 4 being connected to the machine frame 2 via at least two height adjustment devices in the form of lifting columns 7. In the embodiment according to FIG. 1, four lifting columns 7 are provided which can be used to bring the machine frame 2 into a desired plane extending preferably parallel to the road surface 6 which supports, as a minimum, the front tracked ground-engaging units of the chassis 4.

The road milling machine according to FIG. 1 comprises a milling device 8, in particular a milling drum, mounted transverse to the direction of travel 5 and between the tracked ground-engaging units of the chassis 4 as seen in longitudinal direction of the milling machine 1.

The milling device 8 may be adjustable in height via the lifting columns 7 supporting the machine frame 2 or relative to the machine frame 2.

In the embodiment according to FIG. 1, the material 3 milled off by the milling device 8 is discharged onto the loading surface 15 of the transport vehicle 11 via a first conveying device 10 mounted in the machine frame 2 in a preferably stationary fashion which transfers the milled-off material 3 onto a second pivotable conveying device 16. The second conveying device 16 can be pivoted from a neutral position to the left or to the right via piston-cylinder units 22 in order to be able to discharge the milled-off material 3 onto the loading surface 15 even when cornering or in the event of the transport vehicle 11 driving in an offset track, respectively, or in order to be able to better manoeuvre the milling machine 1 when relocating it to a different position. Furthermore, the operator of the milling machine 1 can adjust the angle of inclination of the conveying device 16 by means of a piston-cylinder unit 20 arranged between the machine frame 2 and the second conveying device 16.

It is understood that the designations "horizontal" or "vertical" relate to a machine frame 2 to be aligned parallel to a horizontal road surface 6.

The angle of inclination is adjusted about a horizontal pivoting axis 12, and the pivoting angle about a vertical pivoting axis 14. The horizontal and vertical pivoting axes 12, 14 may be mutually orthogonal or may preferably exhibit a horizontal distance from one another. The distance is preferably in the range between 2 and 10 cm.

The second conveying device 16 may, for example, be pivoted laterally about ±60° in relation to the first conveying device 10, and may furthermore be adjusted from a lower initial position with a shallow inclination of, for example, approx. 4° to 5° upwards to an inclination about, for example, approx. 25° to 30°.

These basic relations also apply to an embodiment of a milling machine 1 in the form of a surface miner.

Figure 2:
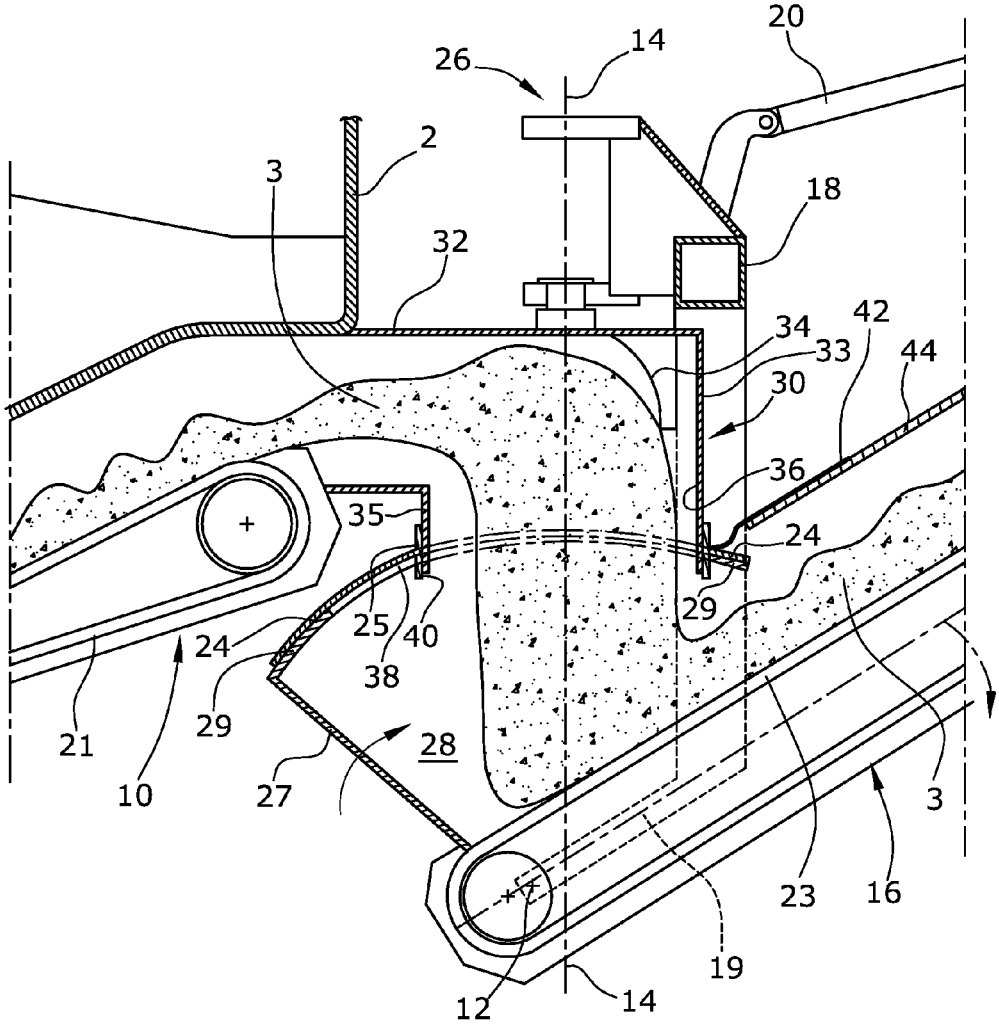
FIG. 2 a section through a transition zone between the transport devices.

FIG. 2 shows a cross-section of the transfer zone from the first conveying device 10 onto the second conveying device 16 under a steep angle of inclination.

A transfer device comprising a transfer element 30 and a reception element 28 is arranged between the conveying devices 10 and 16, with a lid element 24 being provided between said transfer element 30 and reception element 28. The lid element 24 comprises a passage opening 40 which connects a transfer opening 36 of the transfer element 30 with a reception opening 38 of the reception element 28. The transfer element 30 may also be referred to as a transfer housing 30. The reception element 28 may also be referred to as a reception housing 28.

The transfer element 30, the lid element 24 and the reception element 28 form three assemblies movable relative to one another. The transfer device comprises a material feeding zone which is formed by the transfer element 30, a sealing element which is formed by the lid element 24, and a material removal zone which is formed by the reception element 28. A basic idea in this arrangement is that the lid element 24 and the reception element 28 form a spatial interpenetration and, through the joint sectional area, transport the milled-off material 3 from the material feeding zone to the material removal zone. In this arrangement, the lid element 24 is pivotable, relative to the machine frame 2 or to the transfer element 30, respectively, about the pivoting axis 14, or the reception element 28 is pivotable, relative to the machine frame 2 or to the lid element 24, respectively, about the pivoting axis 12.

The milled-off material can thus be transferred from the first conveying device 10 onto the second conveying device 16 without milled-off material 3 or dust being able to exit to the outside, and in every pivoting position and inclination position of the second conveying device 16.

The second conveying device 16 is supported by a portal-like supporting structure 18 which in FIG. 2 is depicted in a sectional view. The supporting structure 18 may also be referred to as a support frame 18.

The transfer element 30, the lid element 24 and the reception element 28 are likewise depicted in a sectional view in FIG. 2 so that the flow of the milled material 3 in the transfer zone is apparent in FIG. 2.

The supporting structure 18 is preferably articulated at the machine frame 2 by means of a bearing 26 and can be pivoted, together with the second conveying device 16, about the vertical pivoting axis 14.

At least one piston-cylinder unit 20 is articulated at the upper end of said supporting structure 18, which can be used to adjust the desired angle of inclination of the second conveying device 16 about the horizontal pivoting axis 12. The horizontal pivoting axis 12 is supported in the supporting structure 18, at the lower end of the same, in supporting arms 19 arranged to both sides of the second conveying device 16.

The adjustment angle of the second conveying device 16 towards the side is performed by means of the piston-cylinder units 22 apparent in FIG. 1 which preferably act between the machine frame 2 and the second conveying device 16 or the supporting structure 18 and are arranged to both sides of the conveying device 16.

The transfer element 30 comprises an inlet port 32 which is adapted to the front end of the first conveying device 10 in such a fashion that it can accept all of the milled-off material 3 from a transport belt 21 of the first conveying device 10. At the point of discharge of the transport belt 21, non-depicted guide plates may, for example, be provided on the bottom side to this effect which are adapted to the parabolic trajectory of the milled-off material 3 apparent in FIG. 2. At the end of the transfer element 30 opposite the point of discharge, an impact plate or an impact grid 34 may also be arranged inside the transfer element 30 which enable milled-off material 3 to be deflected downwards.

The inlet port 32 issues into the tubular part 35 of the transfer element 30, said tubular part 35 having a preferably circular cross-section and being aligned parallel to the vertical pivoting axis 14, in which arrangement the inlet port 32, in the direction of the tubular part 35, may taper conically to the width of the tubular part 35 when seen in top view. The tubular part 35 preferably features, at least in the area of the transfer opening 36 or in the area of engagement with or about the lid element 24, a circular-cylindrical cross-section concentric to the vertical pivoting axis 14 in order to enable rotatability of the lid element 24 relative to the transfer element 30.

At the lower end of the part 35 of the transfer element 30, the transfer opening 36 is located which extends preferably coaxial to the vertical pivoting axis 14 and exhibits a preferably circular cross-section. Said transfer opening 36 issues into a passage opening 40 of the lid element 24 which in turn interacts with the reception opening 38 of the reception element 28. The reception opening 38 extends parallel to the longitudinal extension of the second conveying device 16 and may essentially extend across the entire width of the second conveying device 16.

It is preferably provided for the transfer opening 36 to be arranged in the part 35 in such a fashion that it engages with the passage opening 40 of the lid element 24 and, should the need arise, furthermore also engages with the reception opening 38 of the reception element 28. The lid element 24 may comprise a pipe socket 25 enclosing the part 35, said pipe socket 25 being pivotable relative to the stationary part 35 about the vertical pivoting axis 14.

While the transfer element 30 is attached to the first conveying device 10 or to the machine frame 2 in a stationary fashion, the lid element 24 can be pivoted laterally together with the supporting structure 18 and the second conveying device 16.

The lid element 24 is, for example, attached to the supporting structure 18 in a stationary fashion and is therefore not pivoted about the horizontal pivoting axis 12 when adjusting the inclination of the second conveying device 16.

It is thus achieved that the reception opening 38 extending in longitudinal direction of the second conveying device 16 is closed at least partially by the lid element 24 in every inclination position of the second conveying device 16.

To this end, the lid element 24 and the reception element 28 shown in the cross-sectional view of FIG. 2 are curved about the horizontal pivoting axis 12 essentially in the shape of a circular segment, in which arrangement the reception element 28 and the lid element 24 are adapted to one another with regard to the curvature in such a fashion that the lid element 24 can either rest on a supporting structure or surface 29 of the reception element 28 or can extend at a small mutual distance to the same. It is understood that sealing devices may be provided between the lid element 24 and the reception element 28.

The curvature radius of the surfaces or supporting structures adapted to one another is preferably in the range between 80 and 100 cm, particularly preferably in the range between 80% and 120% of the width of the second conveying device 16. Depending on the belt width, the diameter of the transfer opening 36 and of the passage opening 40 is, for example, in the range between 65 and 110 cm, and preferably between approx. 70% and 100% of the width of the transport belt 23.

The reception element 28 extends in transverse direction to the second conveying device 16, preferably across the entire width of the same, but may also taper upwards in the direction of the lid element 24.

Figure 3:
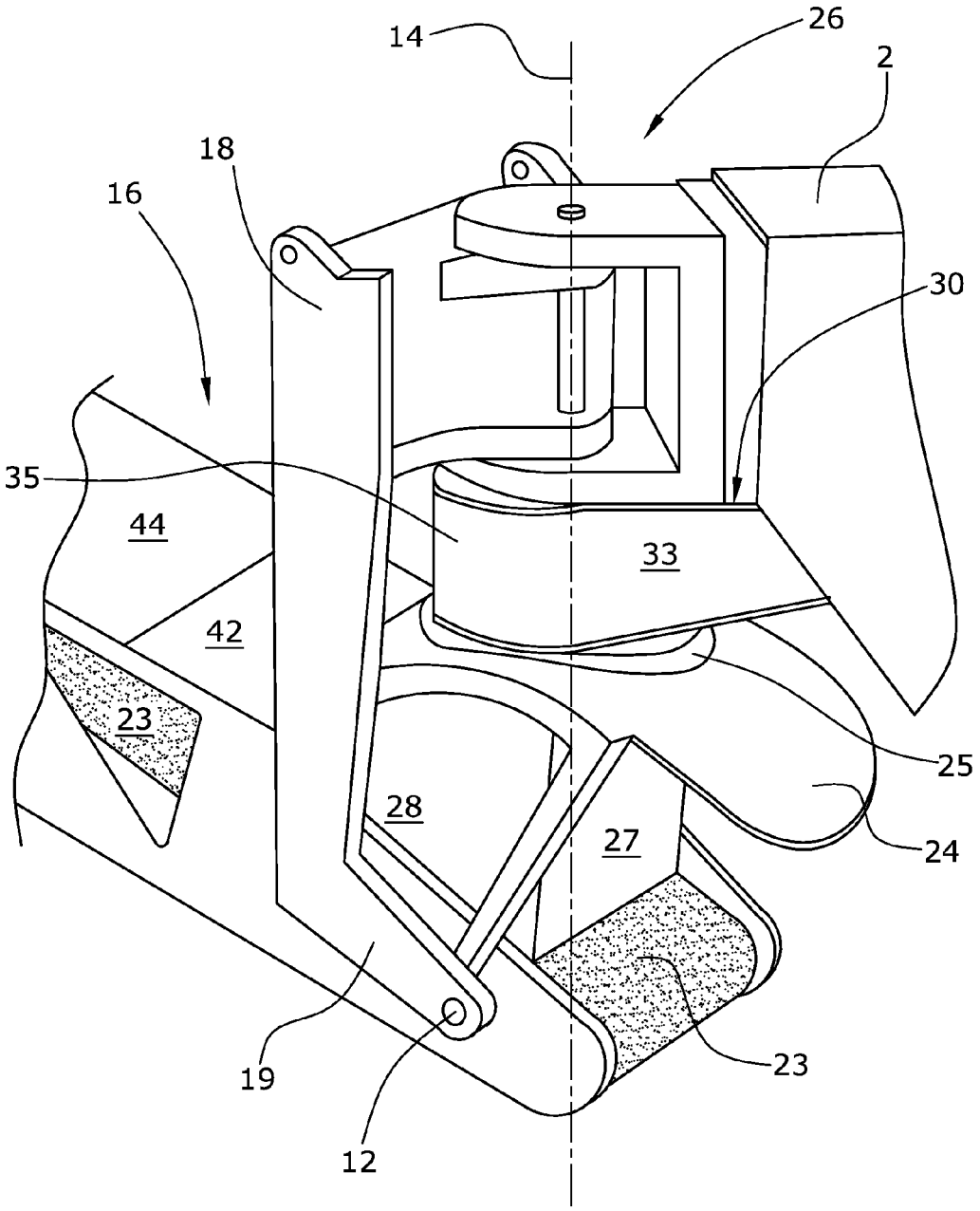
FIG. 3 a perspective view in the direction of the second transport device.

FIG. 3 shows a perspective view of the point of material transfer between the first and the second conveying device 16 under a shallow angle of inclination.

It is also apparent from FIG. 3 that the lid element 24 may project towards the rear if a shallow angle of inclination has been adjusted for the second conveying device 16.

FIG. 2, on the other hand, shows the second conveying device 16 under a steep inclination angle. The transfer element 30 depicted in FIG. 3 represents an embodiment in which the walls 33 of the inlet port 32 and/or of the part 35 are essentially formed from a wear-resistant flexible material, for example, from a fibre-reinforced elastomer material.

The rear wall 27 of the reception element 28 extends obliquely downwards under every angle of inclination of the second conveying device 16, either rectilinearly or curved, in such a fashion that no milled-off material 3 can accumulate within the reception element 28.

A flexible sealing element 42 may be attached to the lid element 24 and may slide on a cover 44 of the second conveying device 16 in order to seal the transition zone between the reception element 28 and the cover 44 in every operating position.

Figure 4:
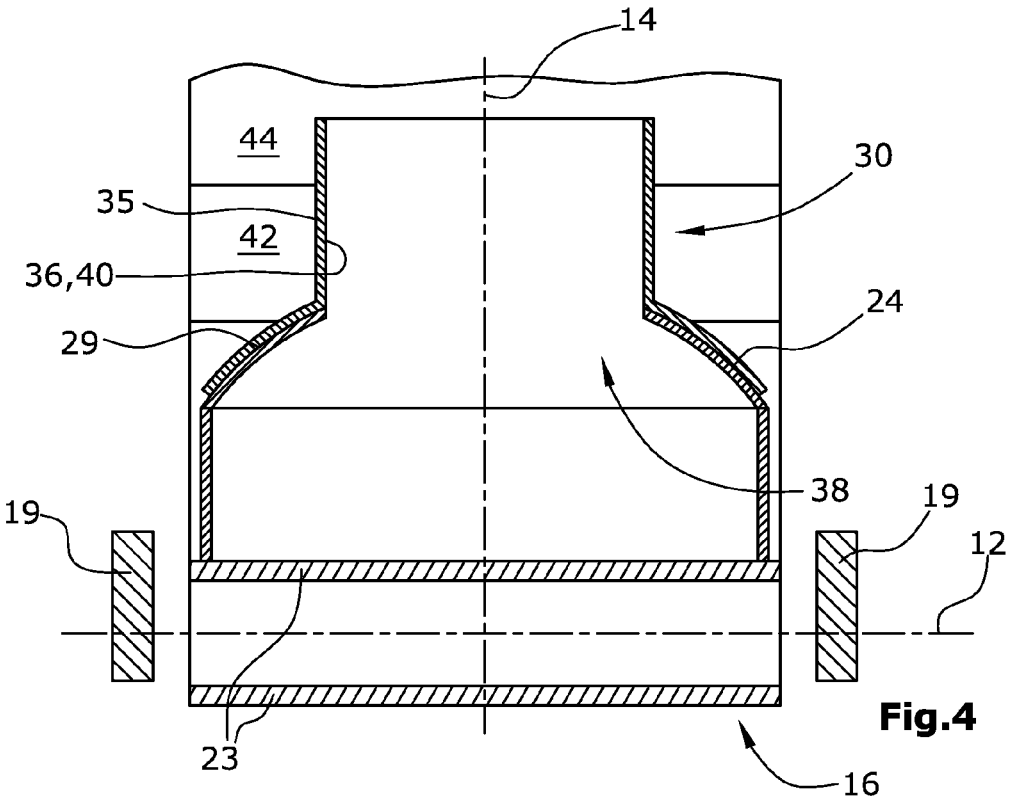
FIG. 4 a section through the second conveying device of a second embodiment with the lid element and the reception element in spherical design, and FIG. 5 a top view of the embodiment according to FIG. 4.

FIG. 4 shows a second embodiment of the transfer device in which the lid element 24 is of integral design with the transfer element 30 and, insofar, is not pivotable relative to the transfer element 30. FIG. 4 is a section in the plane of the vertical pivoting axis 14.

In this embodiment the transfer opening 36 merges with the passage opening 40, forming a uniform opening which interacts with the reception opening 38. If the diameter of the passage opening 40 is to be larger in relation to the width of the transport belt 23, the supporting arms 19 may exhibit a larger mutual distance at least in the area of the lid element 24.

As a component part of the transfer element 30, the lid element 24 is curved spherically, and the reception element 28 is adapted to said spherical curvature on its upper side. In this embodiment, the lid element 24 is not attached to the portal-like supporting structure 18. In top view, the lid element 24 has an outer contour which always covers the possible positions of the reception opening 38 of the reception element 28 within a lateral pivoting range of ±60° and within an inclination range of approx. 25° to 30°.

Figure 5:
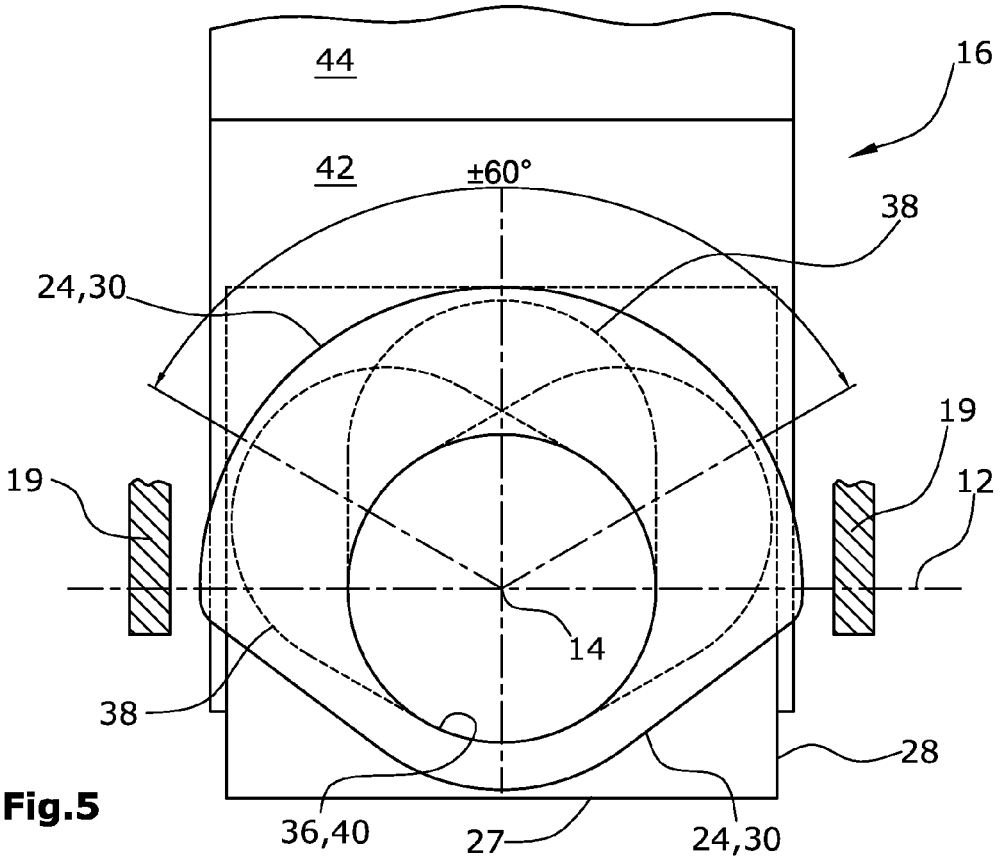

FIG. 5 shows a top view of the embodiment according to FIG. 4 in which the different positions of the reception opening 38 depending on the lateral pivoting position and angle of inclination of the second conveying device 16 are illustrated in dashed lines. Furthermore, an example of the outer contour of the lid element 24 is shown.

FIG. 5 shows a position with a shallow angle of inclination of the second conveying device 16.

The invention claimed is:

1. A milling machine for working ground surfaces, comprising:

a machine frame having a direction of travel;

a milling drum mounted at the machine frame transverse to the direction of travel;

a first conveyor arranged on the machine frame to accept milled-off material from the milling drum;

a second conveyor arranged to receive the milled-off material from the first conveyor, the second conveyor being pivotable, relative to at least one of the machine frame and the first conveyor, about a horizontal pivoting axis in a predetermined inclination angle range and laterally about a vertical pivoting axis;

a transfer housing arranged to receive the milled-off material from the first conveyor and including a first transfer opening essentially coaxial to the vertical pivoting axis and open downwardly;

a reception housing arranged at the second conveyor and including an upwardly open reception opening, the reception housing including a supporting surface; and a lid covering at least a major part of the reception opening, the lid including a passage opening configured to allow communication of the transfer opening with the reception opening, the lid being supported on the supporting surface.

2. The milling machine of claim 1, wherein:

the lid is curved about the horizontal pivoting axis in a circular arc; and the supporting surface is adjacent the reception opening and has a curvature complementary to the circular arc of the lid for supporting the lid.

3. The milling machine of claim 1, wherein:

the lid is pivotable with the reception housing about the vertical pivoting axis relative to the transfer housing.

4. The milling machine of claim 1, wherein:

the reception housing is pivotable, relative to the lid, about the horizontal pivoting axis.

5. The milling machine of claim 1, wherein:

the lid includes a connector coaxial to and protruding towards at least one of the transfer opening and the reception opening.

6. The milling machine of claim 1, wherein:

the reception housing is pivotable, relative to the transfer housing, about the horizontal pivoting axis and the vertical pivoting axis.

7. The milling machine of claim 1, further comprising:

a support frame attached to at least one of the machine frame and the first conveyor, the support frame being pivotable about the vertical pivoting axis, the support frame supporting the at least one second conveyor and including a bearing for the horizontal pivoting axis.

8. The milling machine of claim 7, wherein the lid is connected to the support frame.

9. The milling machine of claim 1, wherein:

the transfer housing is fixed relative to a discharge end of the first conveyor; and the reception housing is fixed relative to the second conveyor.

10. The milling machine of claim 1, wherein:

the supporting surface is in a shape of a segment of a sphere; and the lid is curved about a point of intersection between the horizontal pivoting axis and the vertical pivoting axis in a shape of a segment of a sphere and rests against the supporting support surface of the reception housing.

11. The milling machine of claim 1, further comprising:

a flexible seal connected to the lid and arranged to seal between the lid and the second conveyor.

12. The milling machine of claim 1, wherein the transfer housing and the lid are fixedly attached to each other.

13. A milling machine for working ground surfaces, comprising:

a machine frame having a direction of travel;

a milling drum mounted at the machine frame transverse to the direction of travel;

a first conveyor arranged on the machine frame to accept milled-off material from the milling drum;

a second conveyor arranged to receive the milled-off material from the first conveyor, the second conveyor being pivotable, relative to at least one of the machine frame and the first conveyor, about a horizontal pivoting axis in a predetermined inclination angle range and laterally about a vertical pivoting axis;

a transfer housing arranged to receive the milled-off material from the first conveyor and including a first transfer opening essentially coaxial to the vertical pivoting axis and open downwardly;

a reception housing arranged at the second conveyor and including an upwardly open reception opening; and a lid covering at least a major part of the reception opening, the lid including a passage opening configured to allow communication of the transfer opening with the reception opening;

wherein the reception housing has a cross section normal to the horizontal pivoting axis in a shape of a circular arc of a pipe section concentric to the horizontal pivoting axis, and the reception housing has closed axial ends.

14. A transfer apparatus for a milling machine, the milling machine including a first conveyor for transferring milled-off material onto a second conveyor, the second conveyor being pivotable relative to the first conveyor about a vertical pivoting axis and a horizontal pivoting axis, the transfer apparatus comprising:

a transfer housing including a downwardly open transfer opening, the transfer housing being configured to be fixedly attached to the first conveyor so that the transfer opening is essentially coaxial to the vertical pivoting axis;

a reception housing including an upwardly open reception opening, the reception housing being configured to be fixedly attached to the second conveyor, the reception housing including a support surface; and a lid covering at least a major part of the reception opening, the lid including a passage opening configured to allow communication of the transfer opening with the reception opening, the lid being configured to be supported on the support surface.

15. The transfer apparatus of claim 14, wherein:

the lid is curved about the horizontal pivoting axis in a circular arc when the reception housing is attached to the second conveyor; and the support surface is adjacent the reception opening and has a curvature complementary to the circular arc of the lid for supporting the lid.

16. The transfer apparatus of claim 14, wherein:

the lid is pivotable with the reception housing about the vertical pivoting axis relative to the transfer housing when the reception housing is attached to the second conveyor.

17. The transfer apparatus of claim 14, wherein:

the reception housing is pivotable, relative to the lid, about the horizontal pivoting axis when the reception housing is attached to the second conveyor.

18. The transfer apparatus of claim 14, wherein:

the lid includes a connector coaxial to and protruding towards at least one of the transfer opening and the reception opening.

19. The transfer apparatus of claim 14, wherein:

the reception housing is pivotable, relative to the transfer housing, about the horizontal pivoting axis and the vertical pivoting axis when the reception housing is attached to the second conveyor.

20. The transfer apparatus of claim 14, further comprising:

a support frame configured to be attached to at least one of a machine frame and the first conveyor, the support frame being pivotable about the vertical pivoting axis, the support frame supporting the at least one second conveyor and including a bearing for the horizontal pivoting axis.

21. The transfer apparatus of claim 20, wherein the lid is connected to the support frame.

22. The transfer apparatus of claim 14, wherein:

the support surface is in a shape of a segment of a sphere; and the lid is curved about a point of intersection between the horizontal pivoting axis and the vertical pivoting axis in a shape of a segment of a sphere and rests against the support surface of the reception housing when the reception housing is attached to the second conveyor.

23. The transfer apparatus of claim 14, further comprising:

a flexible seal connected to the lid and arranged to seal between the lid and the second conveyor.

24. The transfer apparatus of claim 14, wherein the transfer housing and the lid are fixedly attached to each other.

25. A method of transferring milled-off material, the method comprising:

(a) transporting the milled-off material with a first conveyor of a milling machine;

(b) transferring the milled-off material from the first conveyor through a transfer opening of a transfer housing;

(c) passing the milled-off material through a passage opening of a lid, the lid covering at least a majority of a reception opening of a reception housing;

(d) receiving the milled-off material through the reception opening of the reception housing onto a second conveyor, the second conveyor being pivoted relative to the first conveyor about a horizontal pivoting axis in a predetermined inclination angle range and about a vertical pivoting axis in a predetermined pivoting angle range and (e) supporting the lid with a supporting surface of the reception housing.

26. The method of claim 25, wherein:

the lid and the supporting surface have complementary circular curvatures about the horizontal pivoting axis.

27. The method of claim 25, wherein:

step (d) further includes pivoting the lid with the reception housing about the vertical pivoting axis relative to the transfer housing.

28. The method of claim 25, wherein:

step (d) further includes pivoting the reception housing relative to the lid about the horizontal pivoting axis.

29. The method of claim 25, wherein:

step (d) further includes pivoting the reception housing relative to the transfer housing, about the horizontal pivoting axis and the vertical pivoting axis.

30. The method of claim 25, wherein:

the lid and the supporting surface have complementary spherical curvatures about a point of intersection between the horizontal pivoting axis and the vertical pivoting axis.

31. A transfer apparatus for a milling machine, the milling machine including a first conveyor for transferring milled-off material onto a second conveyor, the second conveyor being pivotable relative to the first conveyor about a vertical pivoting axis and a horizontal pivoting axis, the transfer apparatus comprising:

a transfer housing including a downwardly open transfer opening, the transfer housing being configured to be fixedly attached to the first conveyor so that the transfer opening is essentially coaxial to the vertical pivoting axis;

a reception housing including an upwardly open reception opening, the reception housing being configured to be fixedly attached to the second conveyor; and a lid covering at least a major part of the reception opening, the lid including a passage opening configured to allow communication of the transfer opening with the reception opening;

wherein the reception housing has a cross section normal to the horizontal pivoting axis in a shape of a circular arc of a pipe section concentric to the horizontal pivoting axis when the reception housing is attached to the second conveyor, and the reception housing has closed axial ends.

* * * * *